US006010417A

United States Patent [19]

Young et al.

[11] Patent Number: 6,010,417

[45] Date of Patent: Jan. 4, 2000

[54] BASEBALL BAT

[75] Inventors: Christopher T. Young, Brevard, N.C.; William P. Hearne, Jr., Salisbury, Md.

[73] Assignee: Young Bat Co., Inc., Brevard, N.C.

[21] Appl. No.: 09/079,803

[22] Filed: May 15, 1998

[51] Int. Cl.[7] ..... A63B 59/06

[52] U.S. Cl. ..... 473/564

[58] Field of Search ..... 473/564

[56] References Cited

U.S. PATENT DOCUMENTS

| | | | |
|---|---|---|---|
| 310,248 | 1/1885 | Brown | 473/564 |
| 795,815 | 8/1905 | Burrows | 473/564 |
| 813,400 | 2/1906 | Buehler | 473/564 |
| 1,549,803 | 8/1925 | Rastetter | 473/564 |
| 1,601,915 | 10/1926 | Hillerich | 473/564 |
| 2,458,919 | 1/1949 | Marsden | 473/564 |

*Primary Examiner*—Mark S. Graham

*Attorney, Agent, or Firm*—Thomas C. Saitta

[57] ABSTRACT

A wooden baseball bat made of plural wood sections bonded together to form a unitary member. The bat is composed of a longitudinally extending central member which is cross-or X-shaped in cross-section transverse to the longitudinal axis, the central member defining four quadrants which are filled with longitudinally extending wedge-shaped members, with the external surface of the bat being circular in transverse cross-section and defining a barrel, handle and knob portion, with the barrel and handle generally tapering so as to diminish in diameter toward the knob. The central member is formed of plural wood pieces arranged such that the grain extends generally radially outward on each arm. Each of the wedge-shaped members is likewise cut and arranged such that grain plane extends generally radially outward. Preferably the central member is made of hickory wood and the wedge-shaped members are made of ash wood. The handle of the bat may be reinforced with an external wrapping or sleeve of fiberglass or similar material.

30 Claims, 2 Drawing Sheets

BASEBALL BAT

BACKGROUND OF THE INVENTION

This invention relates generally to the field of baseball bats or other striking implements used in sporting events, and more particularly relates to bats which are formed from plural pieces of wood rather than being lathed from a single piece. Even more particularly, the invention relates to such bats which consist of four longitudinally extending wedge-shaped members with a curved outer surface which are adhesively joined to central longitudinally extending members forming a cross or X-shape in cross-section.

Wooden baseball bats are typically formed from a single piece of ash wood, ash having desirable properties of hardness and strength. To produce a finished baseball bat, a rectangular billet either rectangular or circular in cross-section is created in an appropriate length and diameter, typically approximately 37 inches long and approximately 2 and ¾ inches in width or diameter. The billet is cut so that the grain of the wood runs longitudinally, and is preferably taken from an outer section of the tree so that the grain runs in a relatively planar manner with as little curvature as possible. The billet is then shaped on a lathe to the particular desired length and profile, the bat having a thick striking portion or barrel, which is tapered into a relatively thin handle portion with a knob on the handle end. An infinite variety of profiles is possible. When striking the ball, the wooden bat is strongest against the grain, i.e., when the striking angle is generally parallel to the plane of the grain, meaning that there are only two optimum striking faces on each bat. If the player improperly rotates the bat so that the ball hits the bat too far off the exposed edge of the grain, the bat may crack or break.

In an effort to improve on various properties of wooden bats, such as to increase strength and flexibility, as well as to provide bats less susceptible to failure when striking the ball, various structures utilizing multiple pieces of wood rather than a single piece have been promoted. One approach has been to utilize laminated wooden sheets, the planar sheets laid in parallel and adhesively bonded to create a solid structure. Examples of this approach are shown in U.S. Pat. No. 1,601,915 to Hillerich, U.S. Pat. No. 5,490,669 to Smart and U.S. Pat. No. 5,620,179 to MacKay, Jr. The strength of the bat is increased because the direction of the grain varies with each lamina, in the same manner that a sheet of plywood is stronger than a comparable thickness single sheet of the same wood. A second approach for multi-piece bats, one which allows for the use of thicker wood sections rather than sheets, is to orient the grain direction of multiple pieces in a more favorable manner so that more than two optimum striking faces are presented around the circumference, i.e., to provide a bat where there is more than the single grain plane or grain edge as found in bats formed from a single piece of wood. Examples of this are shown in U.S. Pat. No. 1,949,325 to Paul, U.S. Pat. No. 2,458,919 to Marsden and U.S. Pat. No. 4,844,460 to Mitchell et al. Paul shows a construction with a square in cross-section central core surrounded by four sets of laminated members extending edgewise from the sides of the core with the corners between the laminate sets filled by right-angle wedges. Marsden shows a bat formed of plural, wedge-shaped, radial segments emanating from a central round core, where the grain plane extends radially in each radial segment. Mitchell et al. shows a bat formed of four right-angle wedge. sections joined such that the grain extends radially from the central axis in four directions. The bat is created by quartering a square cross-sectioned billet, then rotating the individual pieces and bonding them together such that the grain edges extend generally to each corner of the billet, then lathing the billet to produce the round barrel and handle.

It is an object of this invention to provide a wooden bat which is composed of multiple wood sections bonded together in a manner which increases the strength and flexibility of the bat while simultaneously minimizing the likelihood of cracking or failure no matter at what point on the circumference a ball is struck. It is a further object to provide such a bat which comprises a longitudinally extending, cross-shaped in cross-section, central member having four longitudinally extending wedge-shaped members joined to the central member, one within each quadrant, where the grain planes of opposing wedge-shaped members extend longitudinally and are generally parallel to each other, and where in each quadrant at least one grain plane passes through or is parallel to a plane within the body of the wedge-shaped member encompassing the interior apex of the wedge-shaped member and passing through the external circumference, such that the grain extends generally radially from the central axis of the bat. It is a further object to provide such a bat where the central member is composed of hickory and the wedge-shaped members are composed of ash, and further where the central member can be formed of laminated wooden sheets.

SUMMARY OF THE INVENTION

The invention is a wooden baseball bat comprising plural wood sections bonded together to form a unitary member. The bat is composed of a longitudinally extending central member which is cross-or X-shaped in cross-section transverse to the longitudinal axis, the central member defining four quadrants which are filled with longitudinally extending wedge-shaped members, with the external surface of the bat being circular in transverse cross-section and defining a barrel, handle and knob portion, with the barrel and handle generally tapering so as to diminish in diameter toward the knob. The central member is formed of plural wood pieces arranged such that the grain extends generally radially outward on each arm. Each of the wedge-shaped members is likewise cut and arranged such that grain plane extends generally radially outward. Preferably the central member is made of hickory wood and the wedge-shaped members are made of ash wood. The handle of the bat may be reinforced with an external wrapping or sleeve of fiberglass or similar material.

DETAILED DESCRIPTION OF THE INVENTION

With reference to the drawings, the invention will now be described in detail with respect to the best mode and the preferred embodiment. In general, the invention is a wooden baseball bat composed of plural, adhesively joined, wooden pieces which extend in the longitudinal direction and which are aligned and arranged in an optimum manner to produce a bat of increased strength, flexibility and resistance to failure.

Figure 1:
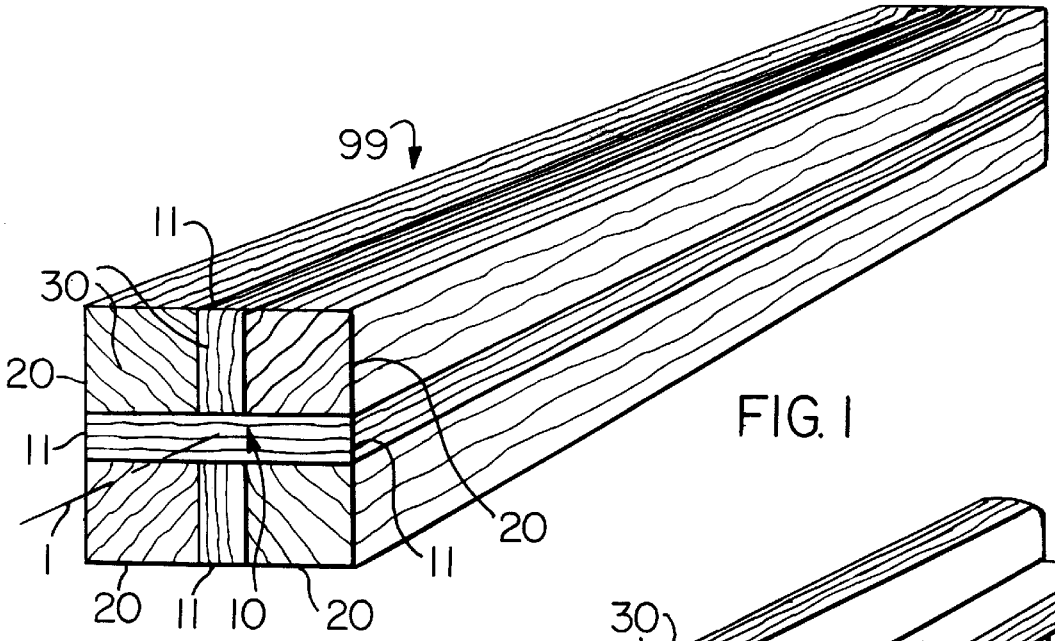
FIG. 1 is a perspective view of a billet showing the preferred arrangement of the central members and the wedge-shaped members.
Figure 2:
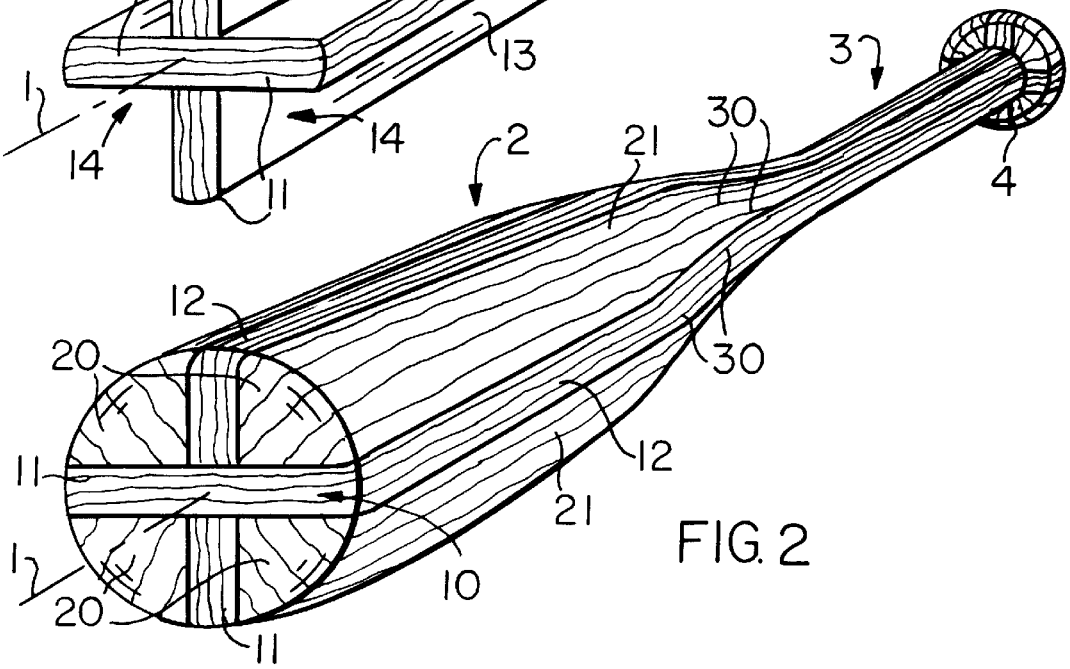
FIG. 2 is a perspective view of the baseball bat after the billet of FIG. 1 has been lathed.

A preferred embodiment of the wooden baseball bat is illustrated in FIGS. 1 through 6, with the bat itself shown in FIG. 2. The bat comprises in general a thick barrel portion 2 which tapers into a relatively thin handle portion 3 and an enlarged knob 4 to prevent the bat from slipping from the player's grip when swung, all of which are circular in cross-sections taken transverse or perpendicular to the longitudinal central axis 1. The particular external shape and configuration of the bat is a matter of choice, and the length, diameter, amount of taper, etc. may vary within acceptable limits. Rather than being lathed or shaped from a single piece of wood, the bat is composed of plural pieces of wood first adhesively bonded together by suitable glues known in the art and then properly shaped, and primarily comprises a central member 10 and wedge-shaped members 20.

Figure 6:
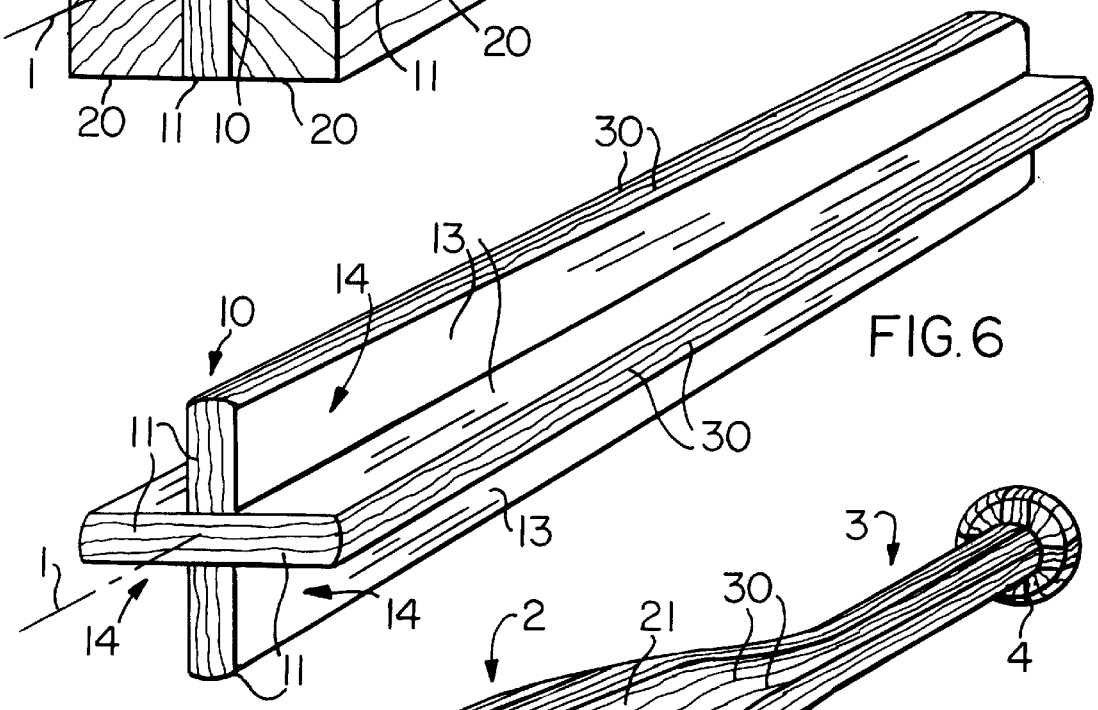
FIG. 6 is a perspective view of the central member.

As seen best in FIG. 6, which shows central member 10 prior to being joined to wedge-shaped members 20 and prior to lathing to form the final bat configuration, central member 10 is a longitudinally extending symmetrical member having a cross or X-shaped configuration when taken in cross-section transverse to the central axis 1. The central member 10 is composed of four arms 11, preferably with each arm 11 oriented at right angles to each adjacent arm 11, and preferably formed from three pieces of wood with one piece extending the full width or diameter of the central member 10 and the other two pieces joined perpendicularly to either side of the full width piece at the center. Each arm 11 has a preferably planar pair of interior side walls 13, preferably parallel, and an exterior surface 12 which will be curved after lathing to produce the final bat shape, with the transverse exterior surface 12 being a segment of a circle. Each adjacent pair of arms 11 defines one of four open quadrants 14 for receiving a wedge-shaped member 20. The length of the central member 10 is preferably about 37 inches or less, the width of the arms 11 is preferably approximately 2 and ¾ inches to 3 inches, and the thickness of the arms 11 is preferably about ½ to ¾ inches. These dimensions will provide a billet 99, as seen in FIG. 1, suitable for lathing any desired size and shape of bat within normal limits.

It is preferable that the pieces forming the central member 10 be cut from wood having grain which is substantially planar such that the grain 30 of the wood extends substantially longitudinally along the central member 10 and such that the grain 30 is substantially parallel to the side walls 13 of each arm 11. In this manner the exterior surface 12 of each arm 11 represents the strongest striking surface, as each arm 11 is strongest in the direction parallel to or against the plane or edge of the grain 30. The quadrants 14 defined by the arms 11 are substantially right angle sections or quarters of a sphere in the finished bat configuration.

Figure 5:
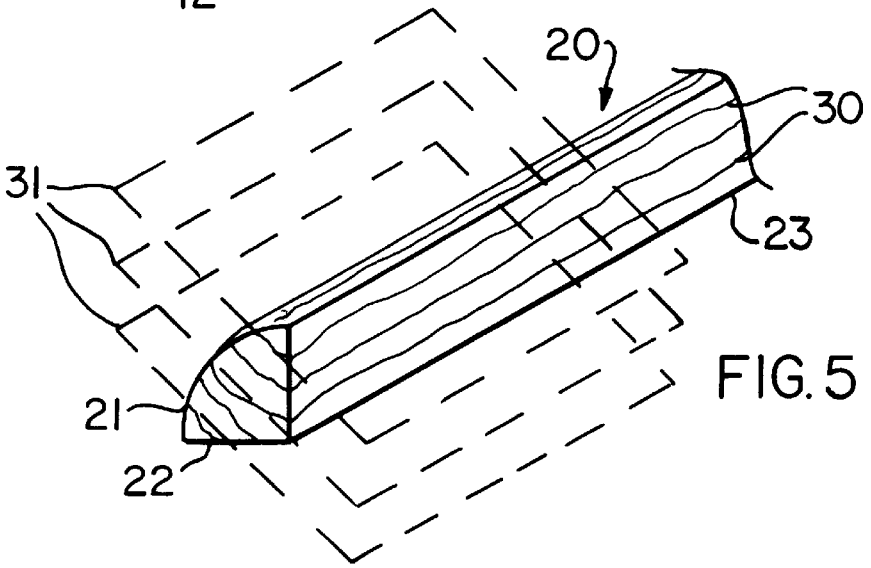
FIG. 5 is a perspective view of a single wedge-shaped member showing the grain planes.

The wedge-shaped members 20 are configured to correspond to the open quadrants 14 of the central member 10, and as such preferably have a pair of interior side walls 22, substantially planar and at right angles to each other, the junction forming a longitudinal edge 23. In the finished bat, the exterior surface 21 of the wedge-shaped members 20 will be curved, being a segment of a circle, but prior to lathing and shaping the wedge-shaped members may be square in transverse cross-section as shown in FIG. 1. The wedge-shaped members 20 are cut from wood having longitudinally extending, substantially planar, grains 30 which are substantially parallel within the wedge-shaped member 20, meaning that the wedge-shaped members 20 are preferably cut from the outer portions of a tree in order to avoid the more curved and non-planar grains 30 which are found toward the center or core of a tree. Each of the individual grains 30 in a given wedge-shaped member 20 defines a longitudinally extending grain plane 31, as illustrated in FIG. 5, a grain plane 31 being defined as the plane which substantially incorporates an individual grain 30. The particular orientation of the wedge-shaped members 20 relative to the central member 10 is determined by the grain direction or direction of the grain plane 31, as the wood is strongest and most resistant to cracking or failure when force is applied into or parallel to the grain plane 31, often described as being applied on the grain 30.

Figure 3:
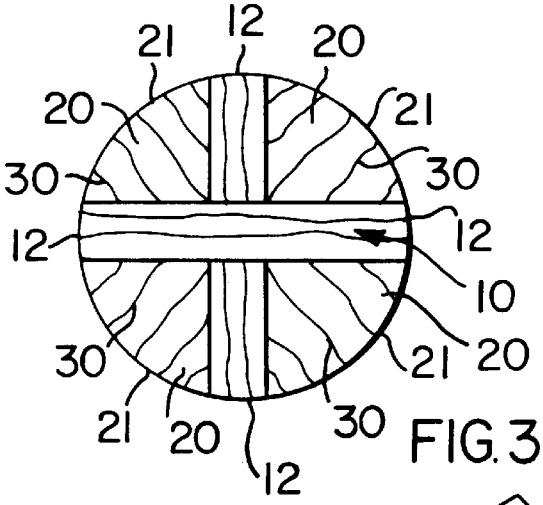
FIG. 3 is a cross-sectional view taken along line III—III through a portion of the barrel of the bat of FIG. 2.
Figure 4:
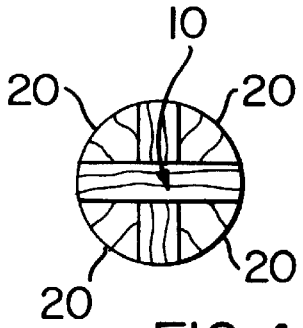
FIG. 4 is a cross-sectional view taken along line IV—IV through a portion of the handle of the bat in FIG. 2.

As shown in FIGS. 1, 3 and 4, the wedge-shaped members 20 are adhesively joined to the central member 10 in the quadrants 14 such that the interior side walls 22 of the wedge-shaped members 20 are joined to the interior side walls 13 of the arms 11, with the longitudinal edge 23 abutting the junction of adjacent arms 11. Each wedge-shaped member 20 is oriented such that the grains 30 or grain planes 31 are exposed on the exterior surfaces 21, such that a grain plane 31 of a given wedge-shaped member 20 passes through the exterior surface 21 and through one of the interior side walls 22 of the wedge-shaped member 20. Alternatively defined, the grains 30 or grain planes 31 extend substantially radially from the central axis 1, such that the grain planes of a particular wedge-shaped member 20 are substantially parallel to a plane incorporating the longitudinal edge 23 and passing through a segment of the exterior surface 21 of the wedge-shaped member 20. In this manner, the grains 30 or grain planes 31 of opposing wedge-shaped members 20 will be substantially parallel.

To form a bat, the central member 10 is constructed and the wedge-shaped members 20 are properly joined as described, resulting in a billet 99 illustrated in FIG. 1. The billet 99 may have a predefined circular cross-sectional configuration if the wedge-shaped members 20 are cut from a circular in cross-section piece of stock material. The bat is then shaped or lathed to a final configuration as shown in FIG. 2, where the barrel 2 tapers into a handle 3. The barrel 2 presents a circular in cross-section striking surface such that the bat is highly resistant to cracking or failure no matter in which direction force is applied, since within a few degrees of any radial direction from the central axis 1 there exists a grain plane 31. Thus the ball will be struck against the grain or substantially parallel to a grain plane every time.

Because the diameter of the barrel portion 2 is greater than the diameter of the handle portion 3, the central member 10 will comprise a larger percentage of the handle 3 than of the barrel 2, as illustrated in FIGS. 3 and 4. Thus the structural and mechanical properties of the handle 3 will vary from those of the barrel 2. By proper selection of wood, desirable properties can be maximized. For example, it is preferable that the central member 10 be composed of hickory wood, which is strong and flexible, while it is preferable that the wedge-shaped members 20 be composed of ash wood, the typical wood of choice for baseball bats because of its hardness. To further strengthen the handle 3, it may be encased in a wrapping or sleeve of fiberglass or like material.

Figure 7:
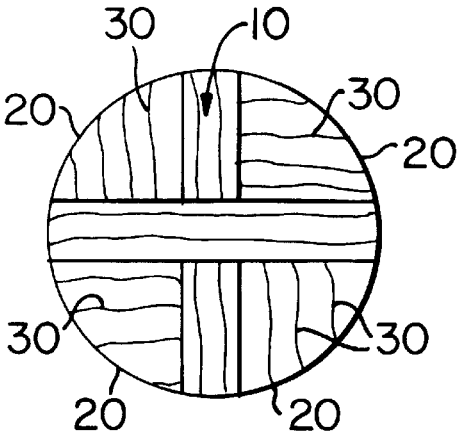
FIG. 7 is a cross-sectional view similar to FIG. 3 showing an alternative embodiment of arrangement of the grain planes of the wedge-shaped members relative to the central member.

FIG. 7 illustrates the most extreme acceptable orientation of the grains 30 or grain planes 31 of the wedge-shaped members 20. Here the grains 30 are substantially parallel to a plane encompassing the longitudinal edge 23 and an edge of the exterior surface 21 of the wedge-shaped member 20. As shown before, the grain plane 31 passes through the exterior surface 21 and one of the interior side walls 22 of the wedge-shaped member 20.

Figure 8:
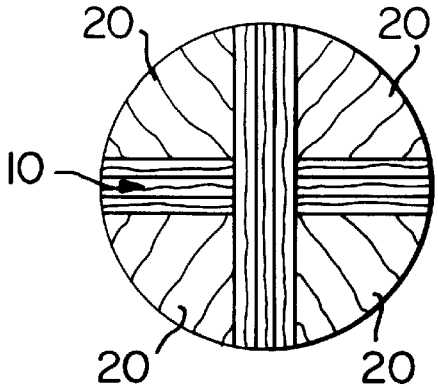
FIG. 8 is a cross-sectional view similar to FIG. 3 showing an alternative embodiment of the central member, where the central member is formed of laminated sheets.

FIG. 8 illustrates a most preferred embodiment of the invention, in which the arms 11 of the central member 10 are composed of laminated members, each being formed by adhesively bonding a number of planar sheets together, with the grain 30 oriented in the optimum direction.

It is contemplated that equivalents and substitutions to certain elements set forth above may be obvious to those skilled in the art, and therefore the true scope and definition of the invention is to be as set forth in the following claims.

We claim:

1. A wooden baseball bat having a longitudinal central axis and comprising a longitudinally extending, cross-shaped central member comprised of arms with curved exterior surfaces and defining four quadrants, and four longitudinally extending wedge-shaped members each having a curved exterior surface, a longitudinal edge and interior walls adhesively joined to said central member, one each of said wedge-shaped members being positioned within each said quadrant, where said central member is made of hickory wood and said wedge-shaped members are made of ash wood.

2. The bat of claim 1, where each of said wedge-members has longitudinally extending, substantially parallel, grain planes, each of said grain planes passing through said external surface of said wedge member and one of said interior walls of said wedge member.

3. The bat of claim 2, where said grain planes of each said wedge-shaped member are substantially parallel to a plane containing said longitudinal edge and passing through said exterior surface of said wedge-shaped member.

4. The bat of claim 2, where said grain planes of opposing said wedge-members are substantially parallel.

5. The bat of claim 2, where said grain planes extend radially outward from said central axis.

6. The bat of claim 1, where each of said arms of said central member has longitudinally extending, substantially parallel, grain planes which extend radially outward from said central axis.

7. The bat of claim 2, where each of said arms of said central member has longitudinally extending, substantially parallel, grain planes which extend radially outward from said central axis.

8. The bat of claim 1, where said central member is comprised of substantially planar sheets of wood adhesively bonded together.

9. A wooden bat comprising a barrel, a handle and a longitudinal central axis, said bat further comprising a longitudinally extending wooden central member having four arms located at right angles to define a cross-shaped central member in cross-section transverse to said central axis and further defining four quadrants, and wedge-shaped members having interior side walls joined to define a longitudinal edge, said interior side walls adhesively bonded to said arms within each said quadrant, said wedge-shaped members and said arms having curved exterior surfaces such that said bat is circular in cross-section transverse to said central axis, where said central member is made of hickory wood and said wedge-shaped members are made of ash wood.

10. The bat of claim 9, where each of said arms is at right angles to the adjacent said arms.

11. The bat of claim 9, where each of said wedge-shaped members has longitudinally extending, substantially planar, grains which are substantially parallel to each other, and where each said wedge member is aligned relative to said central member such that said grains extend substantially radially from said central member.

12. The bat of claim 9, where each of said wedge-shaped members has longitudinally extending, substantially planar, grains which are substantially parallel to each other, and where each said wedge member is aligned relative to said central member such that said grains of each wedge-shaped member extend between said exterior surface of said wedge-shaped member and one of said interior side walls.

13. The bat of claim 9, where each of said wedge-shaped members has longitudinally extending, substantially planar, grains which are substantially parallel to each other, and where each said wedge member is aligned relative to said central member such that said grains extend substantially parallel to a plane containing said longitudinal edge and extending through said exterior surface of said wedge-shaped member.

14. The bat of claim 9, where each of said wedge-shaped members has longitudinally extending, substantially planar, grains which are substantially parallel to each other, and where said wedge members are aligned relative to said central member such that said grains of opposing wedge-shaped members are substantially parallel.

15. The bat of claim 9, where each of said arms of said central member has longitudinally extending, substantially parallel, grain planes which extend radially outward from said central axis.

16. The bat of claim 9, where said central member is comprised of substantially planar sheets of wood adhesively bonded together.

17. A wooden baseball bat having a longitudinal central axis and comprising a longitudinally extending, cross-shaped central member comprised of arms with curved exterior surfaces and defining four quadrants, and four longitudinally extending wedge-shaped members each having a curved exterior surface, a longitudinal edge and interior walls adhesively joined to said central member, one each of said wedge-shaped members being positioned within each said quadrant, where each of said wedge-members has longitudinally extending, substantially parallel, grain planes, each of said grain planes passing through said external surface of said wedge member and one of said interior walls of said wedge member, where said grain planes of each said wedge-shaped member are substantially parallel to a plane containing said longitudinal edge and passing through said exterior surface of said wedge-shaped member.

18. The bat of claim 17, where each of said arms of said central member has longitudinally extending, substantially parallel, grain planes which extend radially outward from said central axis.

19. The bat of claim 17, where said central member is comprised of substantially planar sheets of wood adhesively bonded together.

20. A wooden bat comprising a barrel, a handle and a longitudinal central axis, said bat further comprising a longitudinally extending wooden central member having four arms located at right angles to define a cross-shaped central member in cross-section transverse to said central axis and further defining four quadrants, and wedge-shaped members having interior side walls joined to define a longitudinal edge, said interior side walls adhesively bonded to said arms within each said quadrant, said wedge-shaped members and said arms having curved exterior surfaces such that said bat is circular in cross-section transverse to said central axis, where each of said wedgeshaped members has longitudinally extending, substantially planar, grains which are substantially parallel to each other, and where each said wedge member is aligned relative to said central member such that said grains extend substantially parallel to a plane containing said longitudinal edge and extending through said exterior surface of said wedge-shaped member.

21. The bat of claim 20, where each of said arms is at right angles to the adjacent said arms.

22. The bat of claim 20, where each of said arms of said central member has longitudinally extending, substantially parallel, grain planes which extend radially outward from said central axis.

23. The bat of claim 20, where said central member is comprised of substantially planar sheets of wood adhesively bonded together.

24. A wooden bat comprising a barrel, a handle, a knob and a longitudinal central axis, said bat further comprising a longitudinally extending wooden central member having four arms located at right angles to define a cross-shaped central member in cross-section transverse to said central axis and further defining four quadrants, where each of said arms has longitudinally extending, substantially parallel, grain planes which extend generally radially outward from said central axis, and wedge-shaped members having interior side walls joined to define a longitudinal edge, said interior side walls adhesively bonded to said arms within each said quadrant, said wedge-shaped members and said arms having curved exterior surfaces such that said bat is circular in cross-section transverse to said central axis, said central member and said wedge-shaped members extending the complete axial length of said bat such that both said cross member and said wedge-shaped members form a portion of said barrel, said handle and said knob. where each of said arms has a planar pair of parallel interior side walls. and where said longitudinally extending, substantially parallel, grain planes of said each arm are substantially parallel to said each arm interior side walls.

25. The bat of claim 24, where one opposing pair of arms of said central member consists of a single piece of wood and each of the other arms of said central member consists of a single piece of wood joined perpendicularly to said one opposing pair of arms.

26. The bat of claim 24, where said central member is comprised of substantially planar sheets of wood adhesively bonded together.

27. The bat of claim 24, where each of said wedge-shaped members consists of a single piece of wood and has longitudinally extending, substantially planar, grains which are substantially parallel to each other, and where each said wedge member is aligned relative to said central member such that said grains extend substantially radially from said central member.

28. The bat of claim 24, where each of said wedge-shaped members consists of a single piece of wood and has longitudinally extending, substantially planar, grains which are substantially parallel to each other, and where each said wedge member is aligned relative to said central member such that said grains of each wedge-shaped member extend between said exterior surface of said wedge-shaped member and one of said interior side walls.

29. The bat of claim 24, where each of said wedge-shaped members consists of a single piece of wood and has longitudinally extending, substantially planar, grains which are substantially parallel to each other, and where each said wedge member is aligned relative to said central member such that said grains extend substantially parallel to a plane containing said longitudinal edge and extending through said exterior surface of said wedge-shaped member.

30. The bat of claim 24, where each of said wedge-shaped members consists of a single piece of wood and has longitudinally extending, substantially planar, grains which are substantially parallel to each other, and where said wedge members are aligned relative to said central member such that said grains of opposing wedge-shaped members are substantially parallel.

* * * * *